US011591821B2

(12) United States Patent
Olkay et al.

(10) Patent No.: US 11,591,821 B2
(45) Date of Patent: Feb. 28, 2023

(54) MODULAR CLOSURE DEVICE FOR DIFFERENT CLOSURE ELEMENTS

(71) Applicant: DIRAK Dieter Ramsauer Konstruktionselemente GmbH, Ennepetal (DE)

(72) Inventors: Cem Olkay, Witten (DE); Burkhard Herrmann, Wuppertal (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 235 days.

(21) Appl. No.: 16/497,554

(22) PCT Filed: Mar. 8, 2018

(86) PCT No.: PCT/EP2018/000093
§ 371 (c)(1),
(2) Date: Sep. 25, 2019

(87) PCT Pub. No.: WO2018/192676
PCT Pub. Date: Oct. 25, 2018

(65) Prior Publication Data

US 2021/0102400 A1 Apr. 8, 2021

(51) Int. Cl.
*E05B 9/00* (2006.01)
*E05B 9/08* (2006.01)
(Continued)

(52) U.S. Cl.
CPC ..... *E05B 9/084* (2013.01); *E05B 5/003* (2013.01); *E05B 13/002* (2013.01); *E05B 63/0056* (2013.01)

(58) Field of Classification Search
CPC ..... E05C 9/00; E05B 9/00; E05B 9/084; E05B 5/02; E05B 5/003; E05B 13/002; E05B 13/10; E05B 63/0056; Y10T 70/5765
(Continued)

(56) References Cited

U.S. PATENT DOCUMENTS 5,440,905 A * 8/1995 Yamada ..... E05B 5/003 70/208
5,556,145 A * 9/1996 Takasaki ..... E05B 5/00 292/336.3
(Continued)

FOREIGN PATENT DOCUMENTS

DE 4210588 A1 10/1993
DE 202007004434 U1 8/2008
(Continued)

*Primary Examiner* — Suzanne L Barrett
(74) *Attorney, Agent, or Firm* — The Webb Law Firm

(57) ABSTRACT

A modular closure device for different closure elements, such as finger levers, plate cylinders, profile cylinders, profile half cylinders, for locking a pivot lever in a recess, is described, wherein the closure elements can be inserted and fastened in a receptacle arranged in the recess or the pivot lever, either from the front or from the rear, characterised in that the closure device, which has an interchangeable insert adapted to the closure device and having a different design for the various receptacles, interacts with a guide in such a way that this can be inserted into the recess or into the pivot lever, and the recess or the pivot lever having the inserted interchangeable insert can be plugged in a door leaf through an opening in the door leaf or the like and can be fastened with a cap.

2 Claims, 3 Drawing Sheets

(51) Int. Cl.
*E05B 5/02* (2006.01)
*E05B 13/00* (2006.01)
*E05B 63/00* (2006.01)

(58) Field of Classification Search
USPC ..... 70/208
See application file for complete search history.

(56) References Cited

U.S. PATENT DOCUMENTS

| | | | | | |
|---|---|---|---|---|---|
| 5,893,282 | A * | 4/1999 | Runge | E05B 63/0056 | 70/208 |
| 6,427,501 | B2 * | 8/2002 | Ramsauer | E05B 13/10 | 292/336.3 |
| 7,159,909 | B1 * | 1/2007 | Hung | E05B 1/0092 | 292/336.3 |
| 2006/0028027 | A1 * | 2/2006 | Schlack | E05B 13/002 | 292/75 |
| 2007/0240463 | A1 * | 10/2007 | Antonucci | E05B 1/0092 | 70/208 |
| 2010/0107803 | A1 * | 5/2010 | Ramsauer | E05B 5/003 | 74/510 |
| 2014/0053678 | A1 * | 2/2014 | Gottschling | E05B 63/0056 | 74/523 |
| 2017/0306648 | A1 * | 10/2017 | Ramsauer | E05B 13/10 | |

FOREIGN PATENT DOCUMENTS

| | | | | |
|---|---|---|---|---|
| EP | 2653636 | A2 | 10/2013 | |
| EP | 3887621 | B1 * | 5/2022 | E05B 1/0092 |
| JP | 2010144464 | A | 7/2010 | |
| WO | 9529314 | A1 | 11/1995 | |

* cited by examiner

C-C

D ( 2 : 1 )

MODULAR CLOSURE DEVICE FOR DIFFERENT CLOSURE ELEMENTS

CROSS-REFERENCE TO RELATED APPLICATIONS

This application is the United States national phase of International Application No. PCT/EP2018/000093 filed Mar. 8, 2018, and claims priority to German Utility Model Application No. 20 2017 022 085.8 filed Apr. 21, 2017, the disclosures of which are hereby incorporated by reference in their entirety.

BACKGROUND OF THE INVENTION

The invention relates to a modular closure device for different closure elements, such as finger levers, plate cylinders, profile cylinders, profile half cylinders, for locking a pivot lever in a recess, wherein the closure elements can be inserted and fastened in a receptacle arranged in the recess or in the pivot lever, either from the front or from the rear.

To simplify the storage and production costs, it is desirable to make do with as few pivoted lever constructions as possible, and not to provide a separate recess or a separate control for each closure element, such as a profile cylinder or a profile half cylinder of different types.

SUMMARY OF THE INVENTION

One solution is to allow the closure device, which has an interchangeable insert adapted to the closure device and having a different design for various receptacles, to interact with a guide in such a way that this can be inserted into the recess or into the pivot lever, and the recess or the pivot lever having the inserted interchangeable insert can be plugged in a door leaf through an opening in the door leaf or the like and can be fastened with a cap. This enables the interchangeable insert having the corresponding receptacle of the desired closure system to be inserted interchangeably either in the pivot lever or in the recess from the front or the rear, and to attach it to the pivoting handle or the recess.

According to a further development of the invention, an interchangeable insert for a modular closure device for different closure systems according to the above-mentioned type is provided, characterised by a lever hook fixedly fitted with a surface of the closure device, which therefore has always to be changed therewith, wherein the surface of the closure device closes the lever with an opposite closure surface and is opened such that the closure element actuates the lever hook and thereby releases the lever, and the lever hook is returned to the starting position by a leg spring, so that the lever is closed again without further actuation of the closure element.

Alternatively, however, it is also possible to provide an interchangeable insert for a modular closure device for different closure elements according to the aforementioned type, which is characterised by a lever hook fixedly fitted with a surface of the closure device, which therefore has always to be changed therewith, wherein the surface of the closure device closes the lever with an opposite closure surface and is opened such that the closure element actuates the lever hook and thereby releases the lever and the lever hook is closed again by a further actuation of the closure element.

BRIEF DESCRIPTION OF THE DRAWINGS

The invention will be explained in more detail by means of exemplary embodiments, which are illustrated in the drawings, wherein.

DESCRIPTION OF THE INVENTION

Figure 1:
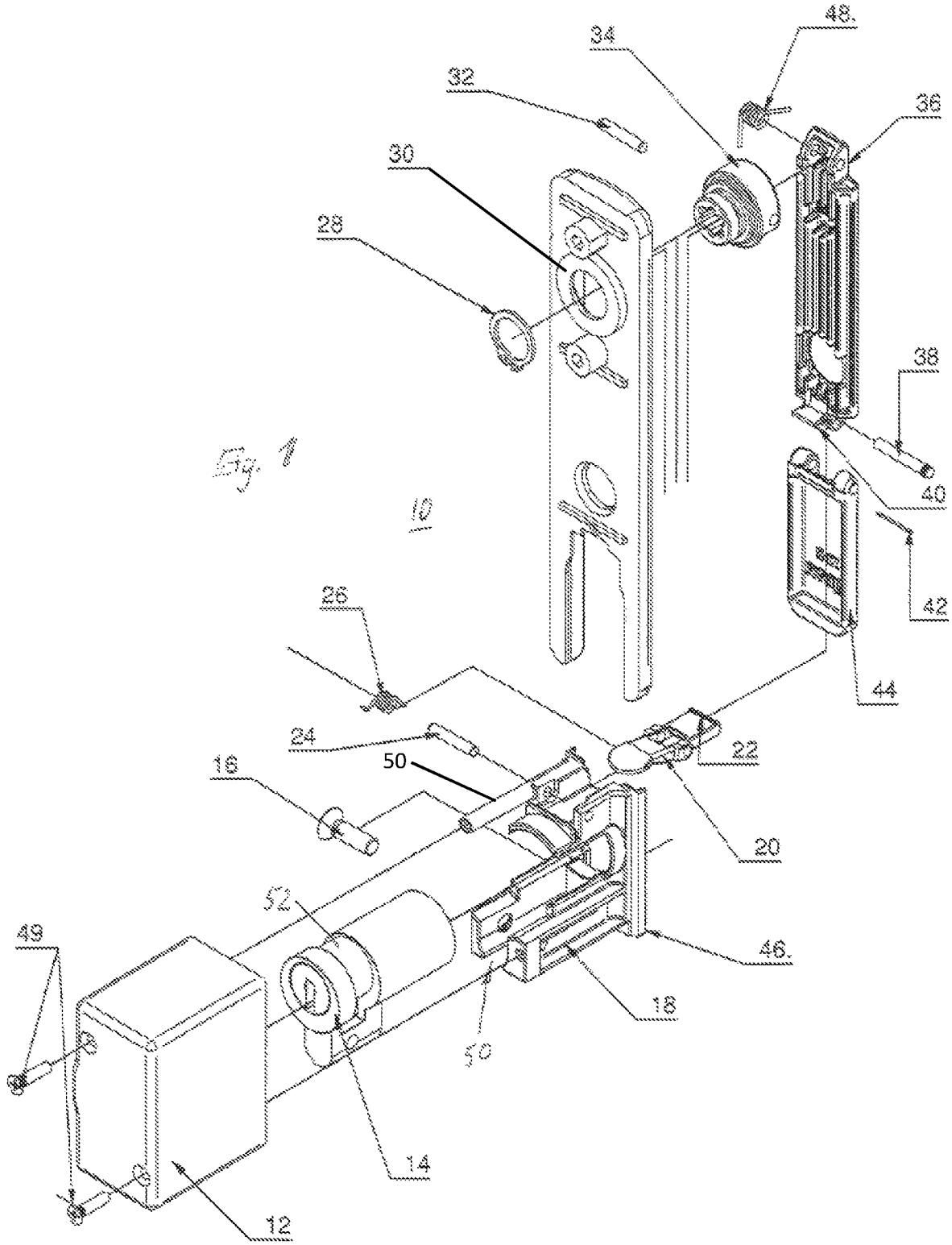
FIG. 1 shows an exploded view of an embodiment of the modular closure device according to the invention.
Figure 2A:
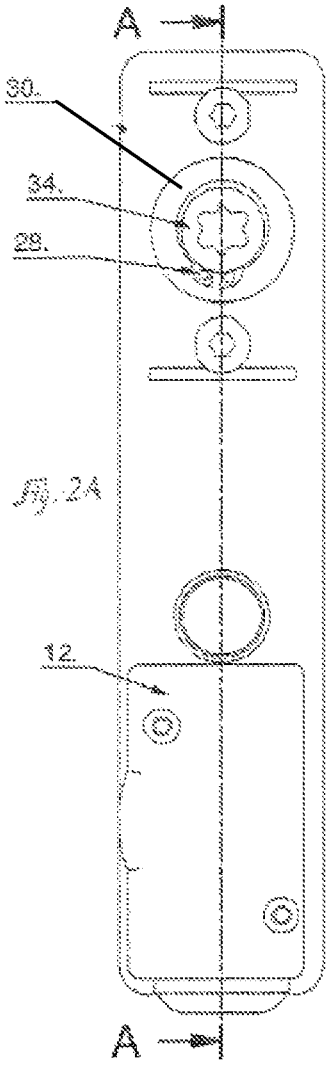
FIG. 2A shows a pivot lever closure assembled from the components of FIG. 1.
Figure 2B:
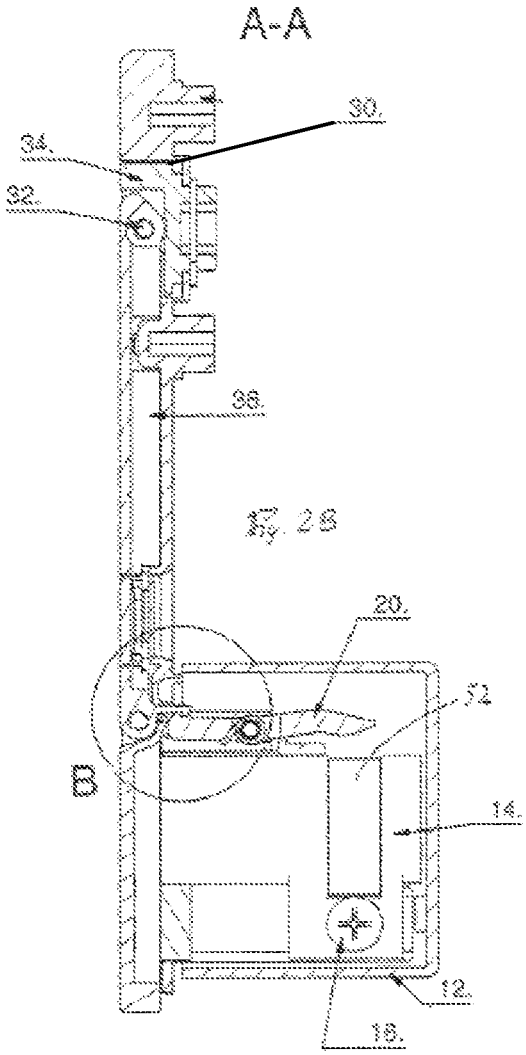
FIG. 2B shows a sectional view along the line A-A of FIG. 2A.

In FIG. 1, a pivot lever 10 according to the invention can be seen in an exploded view, the pivot lever consisting of an interchangeable insert 18 having a receptacle 50. The closure element 14, which is shown in FIG. 1 from the rear, can be inserted into the receptacle 50. The combination of receptacle and closure element can then be inserted via a guide 46 into the recess 30, then the interchangeable insert 18 is fixed by means of a rear cap 12 via the installation opening, and by means of two screws 49, which can be screwed into two supports 53, formed along the closure element 14 by the interchangeable insert 18. The closure element 14 is fixed in the interchangeable insert 18 by means of a screw 16. In addition, there is a lever hook 20 in the interchangeable insert 18, which hooks via a closure surface 22 with the lever 36, on which an opposite closure surface 40 is also located, and prevents the lever 36 from opening, see also FIG. 2C, which shows the lever hook 20 which can be pivoted about a shaft in the form of a pin 24. The opening of the lever 36 succeeds only when the closure element 14 is actuated, which is shown in FIG. 2B as a lock cylinder 14 and actuates the lever hook 20 with its cam 52. Thus, the lever 36 is released, so that this lever 36 can be opened by a leg spring 48, by folding up around the pin 32, which is passed through the spring 48 and about which the lever 36 can pivot.

Figure 2C:
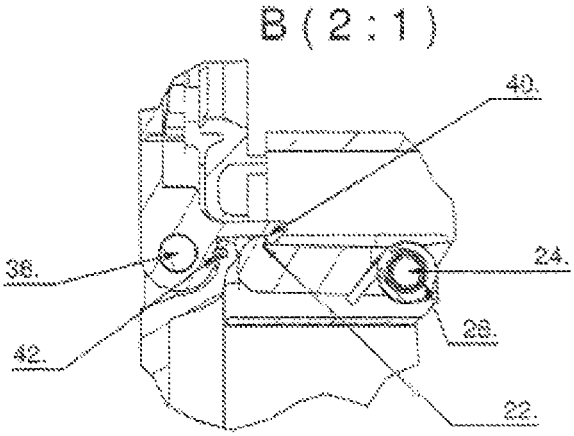
FIG. 2C shows a twice enlarged view of the area B of FIG. 2B.
Figure 3A:
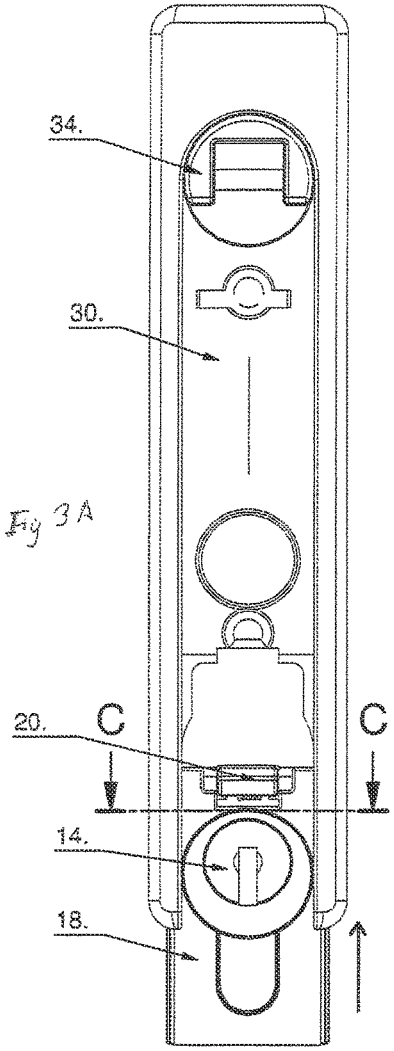
FIG. 3A shows the front view of the pivot lever closure of FIG. 2A.
Figure 4:
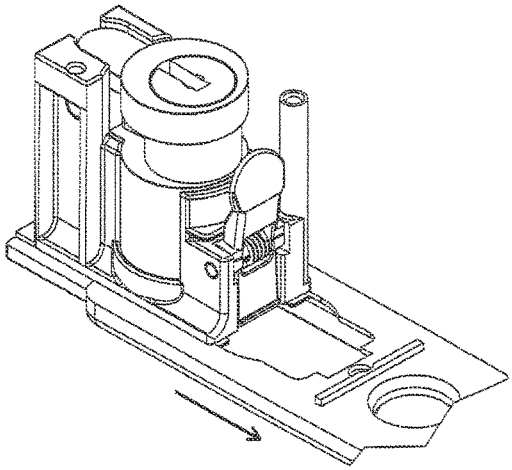
FIG. 4 shows a perspective view of the lower part of the back of the pivot lever closure of FIG. 1.
Figure 3B:
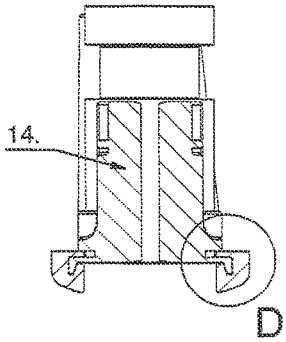
FIG. 3B shows a sectional view along the line C-C of FIG. 3A.
Figure 3C:
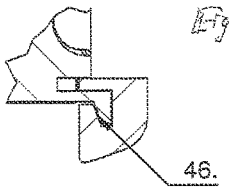
FIG. 3C shows a twice enlarged view of the area D of FIG. 3B.

The leg spring 26, see FIG. 2C, moves the lever hook 20 back into the starting position again, so that the lever 36 can be closed without further actuation of the closure element 14. The mechanism described so far is located exclusively in the interchangeable insert 18.

By replacing the receptacles, having different closure elements, in the interchangeable insert 18, the closure device can be adapted to different applications. For this purpose, only the interchangeable insert must be replaced, that is the component designated in FIG. 2B with the numeral 18, together with the lever hook 20 and the closure element 14.

A knurled pin 38 holds a flap 44 covering the key access of the cylinder 14.

A flap spring 42 keeps the flap 44 closed against a spring force.

The (hand) levers 36 are pivotably held in the usual manner on the actuating shaft or turning plate 34 by means of a pin 32 and rotatably held on the recess 30.

The cap 12 clamps the door panel between itself and the recess 30.

The invention can be commercially exploited in control cabinet construction.

LIST OF REFERENCE NUMERALS

10 Pivot lever
12 Cap
14 Closure element
16 Countersunk screw
18 Interchangeable insert
20 Lever hook
22 Lever hook, closure surface
24 Pin
26 Leg spring lever hook
28 Retaining ring for shafts
30 Recess
32 Pin
34 Turning plate
36 Lever
38 Knurling pin
40 Lever; closure surface
42 Flap spring
44 Cylinder cover
46 Guide
48 Leg spring lever
49 M3 countersunk screw
40 Receptacle
52 Thumb
53 Support

The invention claimed is:

1. A modular closure device for closure elements, such as finger levers, plate cylinders, profile cylinders, profile half cylinders, for locking a pivot lever in a recess, wherein the closure elements are fastened to a receptacle arranged in the recess or the pivot lever, from the rear, wherein the modular closure device, which has an interchangeable insert adapted to the modular closure device, interacts with a guide of the interchangeable insert that can be inserted into the recess or into the pivot lever, and the recess or the pivot lever having the inserted interchangeable insert can be plugged in a door leaf through an opening in the door leaf and can be fastened with a cap, wherein the interchangeable insert comprises a lever hook rotatably fixed with and pivotable about a shaft, wherein a surface of the lever hook closes the lever hook with an opposite closure surface and is opened such that the closure element actuates the lever hook and thereby releases the pivot lever, and the lever hook is returned to the starting position by a leg spring, so that the pivot lever is closed again without further actuation of the closure element, and the lever hook engages with the opposite closure surface of the pivot lever.

2. The modular closure device according to claim 1, wherein the cap also serves for fastening the recess on the door leaf.

* * * * *